United States Patent [19]

Levine et al.

[11] 3,962,858

[45] June 15, 1976

[54] ELECTRONIC WATCH

[75] Inventors: Morris M. Levine, Scarsdale; Arthur F. Cake, Smithtown, both of N.Y.

[73] Assignee: Uranus Electronics Inc., Port Chester, N.Y.

[22] Filed: Aug. 29, 1973

[21] Appl. No.: 392,516

[52] U.S. Cl. ..... 58/4 A; 58/50 R

[51] Int. Cl.[2] ..... G04B 19/24; G04B 19/30

[58] Field of Search ..... 58/4 A, 50 R, 58, 85.5

[56] References Cited

UNITED STATES PATENTS

| | | | |
|---|---|---|---|
| 3,738,099 | 6/1973 | Tamaya | 58/50 R |
| 3,760,582 | 9/1973 | Thiess et al. | 58/85.5 X |
| 3,765,163 | 10/1973 | Levine | 58/50 R |
| 3,766,728 | 10/1973 | Nagy | 58/4 A |
| 3,766,728 | 10/1973 | Nagy | 58/4 A |
| 3,823,551 | 7/1974 | Riehl | 58/50 R |

*Primary Examiner*—Edith Simmons Jackmon
*Attorney, Agent, or Firm*—Bauer, Amer & King

[57] ABSTRACT

An electronic watch including a means to establish a time standard, a means to provide a frequency source from the time standard, a means to divide the frequency source into pulses representing seconds, minutes, hours, days, day of the week, months and years, means to display information visually and a means to drive the display including a control for activating said means to display and setting means to program said means to divide the frequency source.

18 Claims, 8 Drawing Figures

FREQ OSC.
BINARY DIVIDER
÷ 2
120 Hz
60Hz
MR
HM SET
MOS
CONTROL
DIGIT DRIVER
DECODER
÷ 6
÷ 10
DELAY CIRCUIT
SEGMENT DRIVER
DECODER ENCODER
÷ 12
GATE
÷ 60
÷ 12-24
÷ 7
÷ 28-31

FIG. 3

| RESET | OUTPUT (Q) | | |
|---|---|---|---|
| | E | F | G |
| 0 | 0 | 0 | 0 |
| 1 | 1 | 0 | 0 |
| 2 | 0 | 1 | 0 |
| 3 | 1 | 1 | 0 |
| 4 | 0 | 1 | 1 |
| 5 | 1 | 1 | 1 |
| 0 | 0 | 0 | 0 |

FIG. 5

| | H | J | K | L | M | $N_{12}$ | $N_{24}$ |
|---|---|---|---|---|---|---|---|
| 0 | 0 | 0 | 0 | 0 | 0 | 0 | 0 |
| 1 | 1 | 0 | 0 | 0 | 0 | 0 | 0 |
| 2 | 0 | 1 | 0 | 0 | 0 | 0 | 0 |
| 3 | 1 | 1 | 0 | 0 | 0 | 0 | 0 |
| 4 | 0 | 1 | 1 | 0 | 0 | 0 | 0 |
| 5 | 1 | 1 | 1 | 0 | 0 | 0 | 0 |
| 6 | 0 | 1 | 1 | 1 | 0 | 0 | 0 |
| 7 | 1 | 1 | 1 | 1 | 0 | 0 | 0 |
| 8 | 0 | 0 | 0 | 1 | 0 | 0 | 0 |
| 9 | 1 | 0 | 0 | 1 | 0 | 0 | 0 |
| 10 | 0 | 0 | 0 | 0 | 1 | 0 | 0 |
| 11 | 1 | 0 | 0 | 0 | 1 | 0 | 0 |
| 12 | 0 | 1 | 0 | 0 | 1 | 0 | 0 |
| 13 | 1 | 1 | 0 | 0 | 1 | 0 | 1 |
| 14 | 0 | 1 | 1 | 0 | 1 | 0 | 1 |
| 15 | 1 | 1 | 1 | 0 | 1 | 0 | 1 |
| 16 | 0 | 1 | 1 | 1 | 1 | 0 | 1 |
| 17 | 1 | 1 | 1 | 1 | 1 | 0 | 1 |
| 18 | 0 | 0 | 0 | 1 | 1 | 0 | 1 |
| 19 | 1 | 0 | 0 | 1 | 1 | 0 | 1 |
| 20 | 0 | 0 | 0 | 0 | 0 | 1 | 1 |
| 21 | 1 | 0 | 0 | 0 | 0 | 1 | 1 |
| 22 | 0 | 1 | 0 | 0 | 0 | 1 | 1 |
| 23 | 1 | 1 | 0 | 0 | 0 | 1 | 1 |
| 24 | 0 | 1 | 1 | 0 | 0 | 1 | 1 |

466
464
TO 30
TO 118
462
468
420
418
411
410
476
460
416
414
412
470
472
474
478
480
482
458
400
456
486
454
484
408
406
404
402
424
426
422
430
436
428
432
438
442
444
434
440
446
448
450
452

ELECTRONIC WATCH

BACKGROUND

This invention relates to an electronic timepiece, and more particularly to one whose design and arrangement affords a viewer thereof with information of time and calender.

In recent months electronic timepieces, watches which have a fundamental departure from the traditional mechanical escapement both as to keeping time and displaying same, have found a demand in the market place. The breakthrough that has played more of a part in this than anything else is the development of CMOS technology that has enabled manufacturers to produce such timepieces for consumers that have low power consumption, are small in size and weight and have a long life to say little of the lowering cost advantages as this technology blossoms in its marriage with the techniques of integration into a commercially acceptable package.

One of the problems of manufacturing such timepieces, as this invention is directed to, noted in the past, in attempting to use displays of an electronic nature, has been in arriving at an oscillator- frequency converter combination having not only the required frequency stability, but, as mentioned above, to permit use of the small batteries as the power source.

Efforts to solve these conditions for a commercially accetable battery powered wristwatch have been derived to employ four major components, namely a time base, a time computer, a miniature battery power source and an electronic display means. All but the display means have been standarized basically by all manufacturers. The difference of opinion as to displays centers about personal choices of a continuous display or a display that is active on call so-to-speak. The time base that is pretty much the standard now is a frequency oscillator vibrating at 32,768$H_z$. The time computor that is likewise widely accepted is one that will divide this high frequency down to 1 pulse per second by using a multistage integrated circuit binary counter with means to count the pulse train, encode it into binary form and then decode and process the result for the display of information of time including information of date.

It has been noted in all designs for such timepieces to date that it has been necessary to reprogram the watches displaying date information at the conclusion of each month having less than 31 days.

It is a principle object of this invention to improve the circuitry in such aforementioned timepieces to economize manufacture and provide more information therefrom than heretofore deemed possible.

It is the object of this invention to improve upon the electronic timepieces aforedescribed by providing complete calender information in such a way that the time computor has a memory program to avoid setting at the conclusion of any 1 month, which computor is improved to provide calender information of the day of the week, month and year in addition to the day of the month.

It is a further object of this invention to improve such timepieces as afore-described whereby it may be used as a 12 hr. or 24 hr. timepiece.

A still further object of this invention is to provide an electronic timepiece with means to activate the display thereof to illustrate the day and month numerically or alphabetically.

It is also an object of this invention to provide appropriate CMOS means with the ability to provide all these functions of the foregoing objects which may be universally used in installations calling for some or any part of the information and means of display thereof.

DRAWING DESCRIPTION

FIG. 3 is a table showing the relationship between input signals and the BCD output of the part of the circuit of FIG. 2 counting to 6;

FIG. 5 is a table showing the relationship between input signals and the BCD output of the circuit of FIG. 4 counting to 12 or 24;

DETAILED DESCRIPTION

Figure 1:
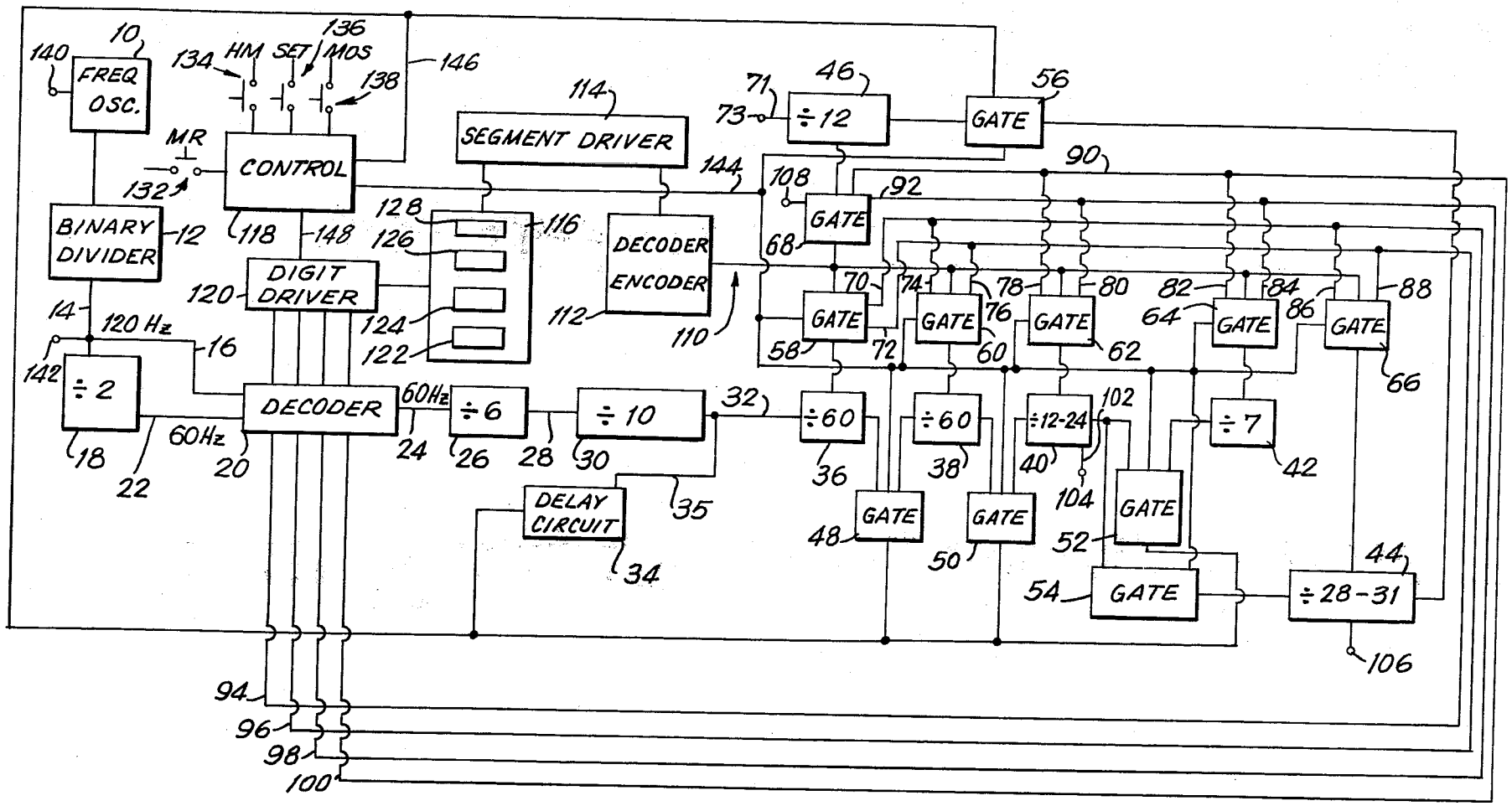
FIG. 1 is a block diagram of an electronic timepiece circuitry according to a preferred form for this invention.

With particular reference to FIG. 1 there is shown a block circuit for an electronic watch according to the principles of this invention having a frequency oscillator 10 providing a frequency of 30.720 $KH_z$. If desired and available AC line voltage may be used instead of a DC power supply to oscillator 10. A static binary chain 12 divides this frequency down to 120 $H_z$ that is directed by leads 14 and 16 to a divide by two circuit 18 and a decoder 20. The divide by two circuit 18 is connected by lead 22 to decoder 20 and through the decoder to lead 24 to a divide by 6 circuit 26 connected by lead 28 to a divide by ten circuit 30 to provide a 1$H_z$ signal to lead 32.

The decoder 20 decodes the 120 $H_z$ and 60 $H_z$ signals to provide digit select pulses ds 1, ds 2, ds 3 and ds 4 that appear in the following order:

Period 1 ds3 period 2 ds 1

Period 3 ds4 period 4 ds2

The circuitry for and waveforms to and out of decoder 20 will be readily apparent to those skilled in the art whereby further description thereof is not deemed necessary.

The 1 $H_z$ signal in lead 32 is distributed throughout the rest of the circuit of FIG. 1. As will also be set forth hereinafter this 1$H_z$ Signal or pulse can be delayed ½ to 1 second by the delay circuit 34 when a setting function for the timepiece is called for. More specifically the 1$H_z$ pulse is continued to a divider chain having, in a preferred embodiement shown by FIG. 1, a divide by 60 circuit 36, another divide by 60 circuit 38, a divide by 12 or 24 circuit 40, a divide by 7 circuit 42, and, a divide by 28 to 31 circuit 44 to a divide by 12 circuit 46 by means of gates 48, 50, 52, 54 and 56, respectively. More specifically, the circuits 36 and 38 comprise divide by 10 and divide by 6 stages with the circuit 36 representing the seconds counter for a gate 58 and the circuit 38 being a minutes counter for the gate 60. The resulting pulse representing an advance in the count of circuit 36 is directed to gate 48 for the circuit 38 whose output pulse then advances the count each hour for gate 50 to allow circuit 40 to provide hours information for a gate 62. Circuit 40 advances the count at the conclusion of each day for gates 52 and 54 to provide circuits 42 and 44 with a signal to advance their count every 24 hours. A pulse is also provided from circuit 44 to gate 56 whereby circuit 46 is activated to advance the count for gate 68 at the end of each month of the year. The circuitry 46 has an output lead 71 for a terminal 73 to provide a means to tap the advancing count at the conclusion of each year of circuitry 46.

The gates 58, 60, 62, 64, 66, and 68 are connected by leads 78, 70, 72, 74, 76, 80, 82, 84, 86, 88, and 90, 92 to leads 94, 96, 98 and 100 from decoder 20 so that the aforementioned order of periods for pulses ds 1, ds 2, ds 3 and ds 4 will segregate the pulses from gates 58, 60, 62, 66 and 68 into appointed time slots. More particularly in the preferred form constructed the tens of seconds is brought out during the ds 3 time, the units of seconds during the ds 4 time, the tens of minutes during the ds 3 time the units of minutes during the ds 4 time, the tens of hours during the ds 1 time the units of hours during the ds 2 time, the numerical day of the week during the ds 2 time, the alpha representation of the day of the week during the ds 1 time, the tens of days during the ds 3 time, the units of days during the ds 4 time the tens of months during the ds 1 time and the units of months during the ds 2 time.

Figure 6:
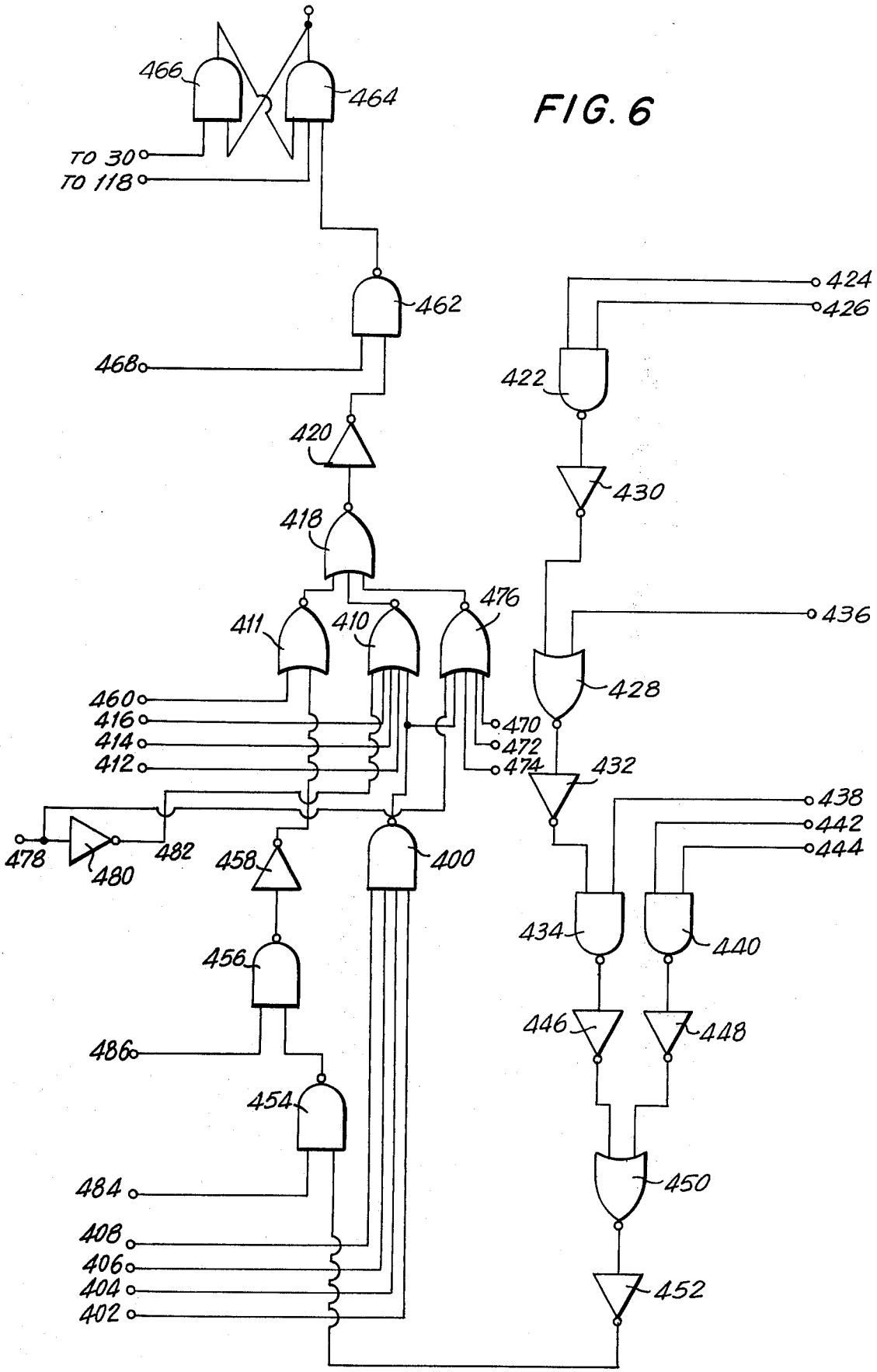
FIG. 6 is a circuit diagram of means to program the count of circuit 44 to advance the count for circuit 46 in accordance with the number of days in a month.

It should be noted that circuit 40 is provided with a lead 102 for a terminal 104 which is operatively connected to gate 62. If the circuit 40 is in a divide by 12 mode this is to provide an indication of AM during the ds 1 time. Also circuit 44 is operatively related to gate 68 by means of a connection (not shown for drawing clarity) between terminals 106 and 108 so that circuit 44 may be programed to provide the right number of days for the respective month of the year. The requirements save for leap years, which is possible to be programed for by suitable circuitry shown in FIG. 6; may be set forth as follows:

| Month | No. of Days |
|---|---|
| 1 | 31 |
| 2 | 28 |
| 3 | 31 |
| 4 | 30 |
| 5 | 31 |
| 6 | 30 |
| 7 | 31 |
| 8 | 31 |
| 9 | 30 |
| 10 | 31 |
| 11 | 30 |
| 12 | 31 |

Therefore the characteristics of the binary chain just described may be set forth as follows:

| Type Of Counter | Drawing Ref. | Characteristics |
|---|---|---|
| seconds | 30 | 00 to 59 |
| minutes | 38 | 00 to 59 |
| hours | 40 | 1–12 or 1–24 |
| day of week | 42 | 1 to 7 |
| day of month | 44 | 1 to 28, 29, 30 or 31 |
| month | 46 | 1 to 12 |

This information from gates 58, 60, 62, 64, 66 and or 68 is supplied by lead (s) 110 to a decoder encoder 112 and to a segment driver 114 for a display means 116 upon command of a control means 118 to a digit driver 120 and to gates 48, 50, 52, 54 and/or 56. In order to coordinate the digit driver with the binary chain it is connected to the decoder to receive the ds 1, ds 2, ds 3 and ds 4 pulses. The display in the preferred form shown has light emitting diodes 122, 124, 126 and 128. These LEDS, as they have been called in abreviated form in the trade, amy all be of the seven segment type, as will display numerical information, or two may have nine segments, as will display alphabetical (alpha) information, or one may be of the two segment type to display units of information as with a twelve hour time piece.

The control 118 is shown to be manually operable, even though it need not be, by means of switches 132, 134, 136 and 138 to act as, respectively, master reset, time in hours and minutes, setting or programing separate function, or calender and time in seconds commands for the aforedescribed circuitry. In such an assembly as shown by FIG. 1 the disply is only activated upon command of the switches 132, 134, 136 and/or 138 in order to conserve power. However, the binary chain is always operating regardless of the control switches so that time and calender information is never still once the battery power source or AC line source is connected to the respective terminals 140 or 142.

Therefore, continuous display means may be connected to the several gates to constantly provide calender and time information. If it is desired to use LED's, then there would be as many as 14 within display 116.

In the battery mode, such as a wristwatch, the switches 134, 136 and 138 are activated by 1.5 volts nominal or 1.4 volts minimum in one form of the invention constructed. Switch 136, as indicated above, is the segregated function setting command means which alone or in conjunction with one or the other switches 134 and 138 enable one to program the proper time and calender information into the time piece after a power source is connected and to adjust same as needed thereafter. The setting of the minutes is accomplished by first operating switch 134 and then switch 136 which activates delay circuit 34 and after ½ to 1 second progress the minutes circuit 38 at a second rate while resetting the seconds to zero momentarily and blocking the gate 50 from sending pulses to hours circuit 40.

If one desires to set the hours circuit 40 it is only required to operate switch 136 to activate delay circuit 34 which after a small time interval will progress the hours circuit 40 at a second rate and gates 52 and 54 are blocked which also precludes pulses to prevent any output from reaching other parts of the binary chain. If all three switches 134, 136 and 138 are operated the delay circuit 34 again operates and in a short time the days of the week circuit 42 progresses at a second rate. Operating switches 136 and 138 together in a similar fashion will progress circuit 44 at a second rate. If switch 136 is momentarily cycled while operating switch 138, than circuit 46 and no other progresses to set the month at a second rate, and in this operation the delay circuit functions to prevent the days of the month progression.

The control signals are forwarded from control 118 by lead 144 to all the aforementioned gates. The setting signals are forwarded by lead 146 to gates 48, 50, 52, 54 and 56. A lead 148 connects the control 118 to the digit driver to drive the display in accordance with control commands.

Figure 2:
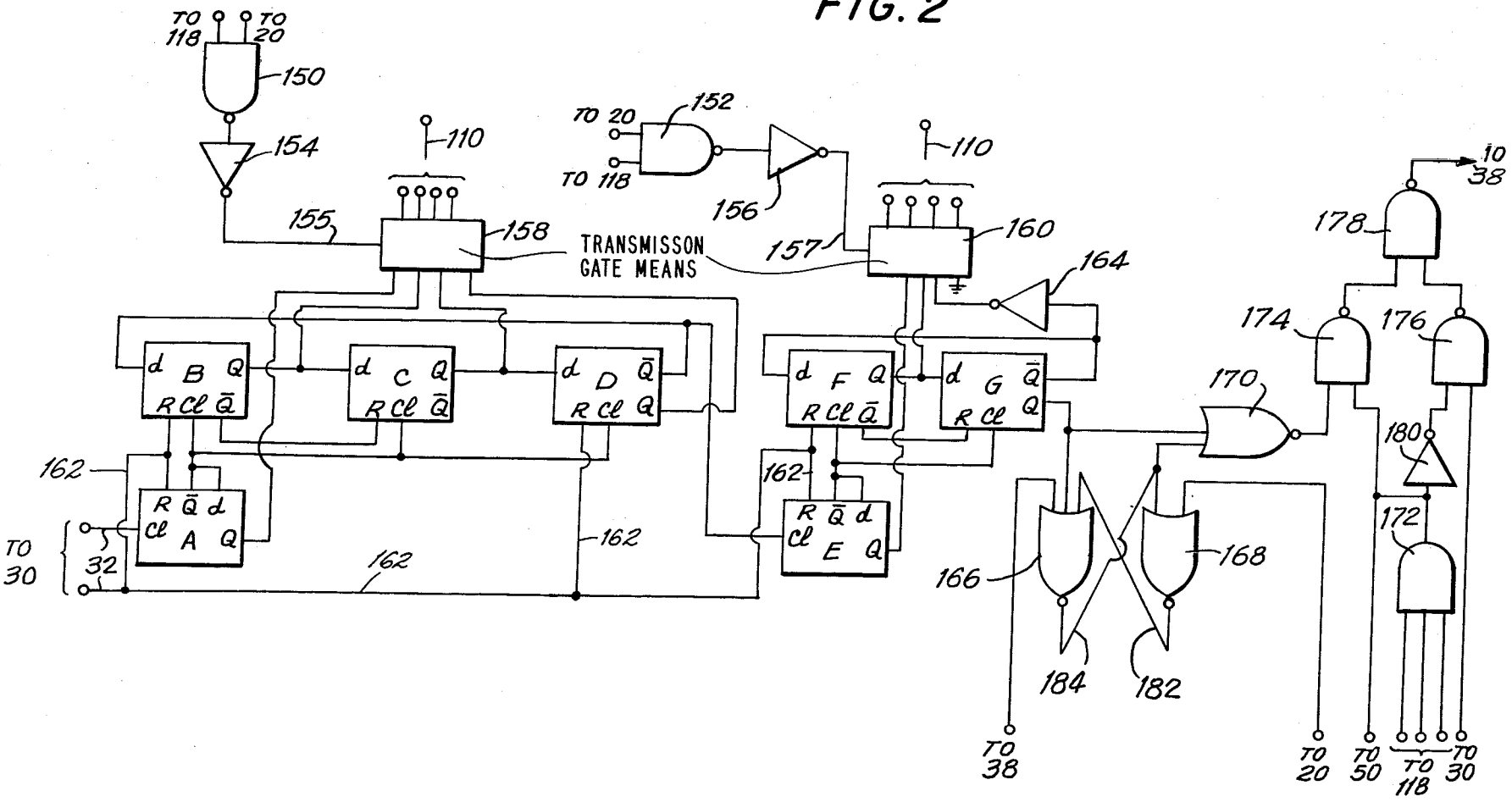
FIG. 2 is a circuit diagram of the divide by 60 or seconds circuit 36.

With reference to FIG. 2 there is shown a binary circuit having flip flops A and E driving shift registers B, C, D, F, amnd G connected in such a way as to provide counter information for tens of seconds and for units of seconds to the gate means 58 shown to comprise NAND gates 150 and 152, inverter amplifiers 154 and 156 and transmission gate means 158 and 160. The $1H_Z$ input signal from line 32 is provided to the register A being introduced at the clock input CL. A reset lead 162 is connected to flip flop A and E and to registers A, B, D, and F at the reset input R thereof. The shift registers B, C and D are connected in series, as are the shift registers F and G. As seen by FIG. 2 and the $\overline{Q}$ output of the shift register D is connected to the data input d of shift register B and to the CL input of shift register E. In a similar manner the $\overline{Q}$ output of shift register G is connected to the data input d of shift register F and to inverter 164. In connecting the $\overline{Q}$ output there is formed a toggling flip flop whose data input is reflected at the Q output at each Clock input CL.

A typical binary divides on a base 2. There have been devised many circuits to take the base 2 division and change it to provide a divide by twelve, ten and six output but none were known to arrange the binary flip flop circuitry as above-described in connection with FIG. 2 to automatically provide the proper binary base division by the interconnection of the flip flops and shift registers. This is illustrated by FIG. 3 in reference to the units counter provided by the divide by six circuitry of flip flop E and shift registers F and G showing their relationship with the input signals and the binary coded decimal output of the counter. As may be realized by those skilled in the art each time the $\overline{Q}$ output of shift register D is advanced a clock signal is received by Flip Flop E. (This is provided at d whenever the pulse at input CL for flip flop E forces shifting thereof.) This in turn provides input to E forcing it to toggle.

Whenever E toggles it provides the CL input to registers F and G. Therefore, if $\overline{Q}$ of flip flop E goes positive a pulse is transmitted to the clock inputs CL of shift registers F and G. The next input will cause the d input of flip flop E to be transferred to Q causing Q to go to 1 and $\overline{Q}$ to 0. The next input again transfers the data on d to be transferred to Q causing Q to go to 0 and $\overline{Q}$ to 1. This shifts the shift registers F and G, and since $\overline{Q}$ of G is connected to d of F, and $\overline{Q}$ is 1, Q of F becomes a 1. However, as Q of F previous to this was 0, G does not change. The next pulse at CL of E causes Q of E to go to 1 and $\overline{Q}$ goes to 0 without F and G shifting. The next pulse at the clock input CL of E causes Q to go to 0 and $\overline{Q}$ to 1. This then shifts F and G causing Q of F to be 1 and Q of G to be 1 also. The next pulse then flips Q of E to 1 with $\overline{Q}$ going to 0 without shifting F and G. The next pulse changes Q of E to 0 and $\overline{Q}$ of E to 1 whereupon shift registers F and G shift. Since the Q of G was 1 and the $\overline{Q}$ of G 0 the data input d of F transfers to 0 to Q of F and drives the $\overline{Q}$ of F to 1. The $\overline{Q}$ output of F resets the shift register G so that its Q output goes to 0 and its $\overline{Q}$ goes to 1, whereupon the divide by 6 circuit is recycled. Therefore, the circuit provides an automatic six count for providing continuous information of the tens of seconds to transmission gate 160. The interconnection of the flip flop A and shift registers B, C and D, will, in a manner similar to that described for flip flop E and shift registers F and G, provide an automatic ten count representing the units of seconds to transmission gate 158, as will be obvious to those skilled in the art in understanding the operation aforedescribed and represented by the truth table of FIG. 3., such that whenever $\overline{Q}$ shift register D goes to 1 a pulse is delivered to the clock input of flip flop E. This occurs at each 10 count.

As seen also the transmission gates 158 and 160 receive inputs from lines 155 and 157 such that whenever information from control 118, decoder 20 and the inputs from control 118, decoder 20 and the inputs from the respective shift registers is true, appropriate information is provided to line 110 to the decoder encoder 112.

Also shown by FIG. 2 is a differentiator circuit comprising NOR gates 166, 168 and 170 which, along with NAND gates 172, 174, 176 and 178 and inverter 180, are elements of gate 48. In previous designs for electronic or solid state timepieces, as they have been termed in the field, it has been thought necessary to use capacitor means to prevent inadvertant advance of successive counters when setting the next higher counter such as the advance of minutes counter circuit 38 after it has been set by control 118. This has proven to be extremely burdensome in the manufacture of a CMOS device such as desired by the industry, and the use of a differentiator circuit, such as shown by FIG. 2 whereby NOR gates are utilized, has been found in the pursuit of this invention to not only economize the manufacture by reason of higher yield of quality CMOS devices but to functionally improve the prevention of stray pulses from the lower order counter after an advancing setting by control 118. More particularly, the NOR gate 166 is connected to be controlled by the Q output of the shift register G, the counter 38 and the output of NOR gate 168 because of the feedback connection 182. The output of NOR gate 166 is connected by line 184 to the input of NOR gate 168, whose other input is from decoder 20. Line 184 is also connected to NOR gate 170, whose other input is from the Q output of shift register G. In such a connection any pulse from the Q output of shift register G after setting of counter circuit 38 will have its time duration reduced by the differentiator circuit such that any high pulse from shift register G will be dropped within a short interval after the setting operation for circuit 38.

The advance or setting circuit of gates 172, 174, 176, 178 and inverter 180 allows either the advance of counter 38 through the differentiator circuit aforedescribed, or, if a setting switch in control 118 sends a signal to gate 172, gate 176 is enabled to advance counter 38 at a $1H_Z$ rate as provided from divider circuitry 30. More particularly, if the three inputs from control 118 to gate 172 are all 1's the output of NAND gate 172 is 0. This output is fed through inverter 180 to enable gate 176 whereby the $1H_Z$ signal can be applied to gate 178 thence to the circuit 38 in that gate 174 also has a high output because of the low input from gate 172 thereto. This allows the setting function to advance the circuit 38 at a $1H_Z$ rate. If, on the other hand, the inputs from control 118 to gate 172 are not all 1's then 172 has a 1 output. Therefore, inverter 180 changes this to a 0 to inhibit gate 176 driving its output to 1; and as gate 174 is enabled by the high output of gate 172 an advancing pulse from the differentiator NOR gate 170 is transferred through gate 174 to enable gate 178 and thereby advance the counter circuit 38 one count when such is called for.

The circuit 38 is comprised of the same elements of FIG. 2 for counting the units and tens of minutes, as aforementioned.

Figure 4:
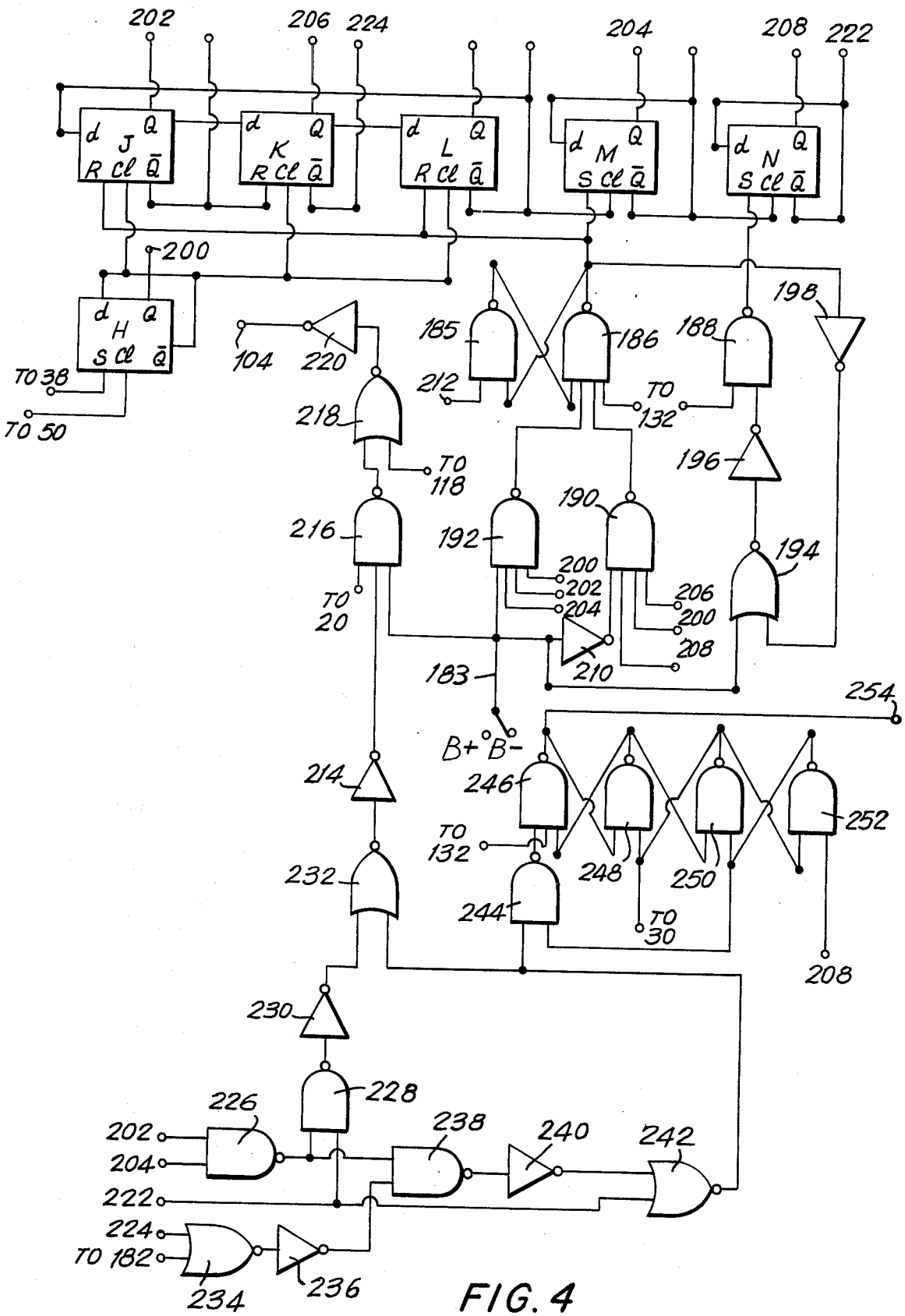
FIG. 4 is a circuit diagram of the divide by 12 or 24 hours circuit 40.

Circuit 40 on the otherhand is a bit different. This circuit is illustrated by FIG. 4 and its operational truth table is seen by FIG. 5. representing the binary counting sequence. The circuit can count to twelve or twenty-four depending on whether the input lead 183 is connected to B+ or B− of the watch power supply. If the lead 183 is connected to B+ it is put in a 1 state and the circuit 40 becomes a twelve hour counter. If the lead 183 is connected to B− it is put in a 0 state and circuit 40 becomes a twenty four hour counter. As mentioned previously, when the counter circuit 40 is to function as a twelve hour counter, an additional data output at lead 104 is made available preferably during setting to show AM or PM, so that the watch may be readily viewed or set with reference to the proper twelve hour interval.

Turning now to the specifics of the counter circuit 40, as may be appreciated by those skilled in the art, it is desireable, as with the divide by six circuit aforementioned, to automatically reset the counter at the proper twelve or twenty-four count. In FIG. 4 this is accomplished by gates 185, 186, 188, 190, 192, 194 and inverter 196 and 198. Actually gates 190 and 192 select the resetting count for shift registers J, K, and L and binary M through set-reset binary made up of gates 185 and 186. If a twelve hour clock is selected gate 192 is enabled and gates 190 and 194 are inhibited. If a 24 hour clock is selected gates 190 and 194 are enabled and gate 192 is inhibited.

Assuming it is desired to have a watch counting in the 12 hour mode, then it is desireable to recycle to 1 at the conclusion of each twelfth hour. Also it is desireable to advance the day count for circuits 42 and 44 at midnight and not at noon or one o'clock AM. Therefore, as seen by the table of FIG. 5 the Q outputs on pins 200, 202 and 204 are all high, 1, at the thirteenth count for circuit 40. Since these pins are connected to gate 192 all inputs to gate 192 are true and its output is 0. Since gate 190 is inhibited, in that its inputs are not all true, it is in a low output, which because of the characteristics of NAND gate 192 causes gate 186 to go high to reset shift registers J, K, and L, and binary M to a zero state. Also, as the binary H is in a 1 or high state it stays in a high state setting shift registers J, K, and L and binary M to the binary number 1 and binary N to a 1 or high state for the second twelve count, which binary N shall return to its low or 0 state on completion of the second twelve count automatically.

In a twenty four count mode where lead 183 is connected to B-, then gate 190 is enabled thru inverter 210 and when the count reaches twenty-five the outpt of gate 190 goes low forcing gate 186 high to again reset registers J, K, and L and binary M to a zero state. Again, as binary H is high at the twenty-five count, it remains high allowing the count to go to a 1. Therefore, the output of gate 186 is inverted by 198 to a low. Two lows are then provided to NOR gate 194 since the lead 183 is also a low, and the output of inverter 196 is a low. This enables gate 188 to a 1 to reset binary N to a 0 whereupon the cycle automatically starts over again. This resetting time is dependant on how long gate 186 is in its 1 state resetting registers J, K and L and binary M. This time is determined by the set-reset NAND gates 185 and 186 in that one half cycle after gate 186 goes high the 1 $H_z$ signal from circuit 30 at pin 212 of gate 185 goes low forcing NAND gate 185 to go to its 1 state. This makes all inputs to NAND gate 186 true so that it goes to its 0 state in that the inputs to NAND gates 192 or 190 being true have caused NAND gates 192 or 190 to go back to 1.

With more particular reference now to the means to provide an AM indication during setting of the watch, an output of inverter 214, to be further described hereinafter, is a 1 in the AM twelve hour period. NAND gate 216 will be true then, if the lead 183 is connected to B+ and the signal from decoder 20 is high, as during the period ds 1 aforedescribed. This drives the output of gate 216 low, and, if the hours setting switch 136 of control 118 is also operated to provide a low input to NOR gate 218, its ouput goes to 1 to be inverted by inverter 220, to 0 and be directed to decoder encoder 112 for display of the AM time interval on the display means 116.

As indicated above it is necessary to provide the advance for the date and day counter circuits 44 and 42 at 2400 or midnight and not at 1 o'clock AM. This is accomplished by means of gates 226, 228 and 232 with inverters 230 and 214. NAND gate 226 is connected to the Q outputs 202 and 204 of shift register J and binary M which give a 0 output at twelve o'clock midnight. NOR gate 234, being connected to the $\overline{Q}$ output pin 224 and to lead 183 will provide a high output for inverter 236 to provide a low or 0 state for NAND gate 238 which drives inverter 240 to provide a signal to NOR gate 242 which is also connected with Q output of binary N as is NAND gate 228. Therefore, if in a twenty four hour mode, NOR gate 234 is high during the counts 4 thru 7, 14 thru 17 and 24 thru 17. The outputs of gate 226 and inverter 236, as stated above, are fed to gate 238 whose output is high when either gate 226 or inverter 236 outputs go low. This high output is provided to inverter 240 to give a low output, at these times. Inverter 240 and the $\overline{Q}$ output of binary N, when above the number 12 in FIG. 5, will drive gate 232 high in the 12 hour mode. This occurs above the number 19 in the 24 hour mode. Gate 242 will also be in a 1 state output when gate 234 is operating between the four to seven count mode in the units digit and the twenty count mode in the tens digit as designated by gate 192. This occurs at the count of 24 and a one output from gate 242 is then fed immediately to the differentiation circuit in gates 52 and 54 as represented in FIG. 4 by gates 244, 246, 248, 250, 252.

Prior to an output pulse from gate 244 gates 246 and 250 are in a zero state, gate 248 is in a one state due to the 1$H_z$ signal from circuit 30 and gate 252 is in a one state because of the Q output 208 from binary N (See FIG. 5) Gates 248 and 252 are therefore enabled. Gate 244 is enabled by the outputs of gates 242 and 252 to drive its output to 0. This then forces gate 246 high to force gate 248 low and so on to have gate 250 high and gate 252 low. When gate 252 goes to 0 gate 23 is inhibited. However, one-half second later the 1$H_z$ signal goes low to bring gate 248 high and gate 246 back to its low or 0 state with gates 250 and 252 staying in the state set until binary N again goes low. This is one hour later during which no trigger signals are passed via terminal 254 to gates 52 and 54 (See FIG. 1.) The output signal from gate 226 at 254 is then a one half second positive going signal occuring at the proper time.

With reference to the AM indication, gate 228 is in its 0 state unless the count is 12 or unless the $\overline{Q}$ outpt 222 is low or in the second 12 hour interval. At these latter times gate 228 has a 1 output which inverter 230 turns to a low that in conjunction with gate 242 output being 1 causes gate 232 to be 0 and inverter 214 output to be 1 giving an indication of AM that is available for display when control 118 is calling for a programing of the hours and minutes circuits 40 and 38.

As may be appreciated by those skilled in the art the foregoing arrangement of the binary H, M and N and shift registers J, K and L can be adopted to provide an automatic 31 counter for circuit 44. However in that not all months of the year have 31 days, as seen by the chart set forth in a preceeding paragraph, it is necessary to program this circuit accordingly so that for any given month the count for the circuit 46 is advanced at midnight of the last day of the month. A means to provide such programing is provided by the arrangement shown in FIG. 6.

In greater detail there is shown a NAND gate 400 having inputs 402, 404, 406 and 408 connected to the outputs of the months counter 46 for decoding out the second month i.e. February. The second month when decoded brings the output of NAND gate 400 low, which is inturn fed to NOR gate 410. NOR gate 410 is also connected to leads 412, 414 and 416 of the days of the month counter for decoding out the 28th day of the second month. When all the inputs to NOR gate 410 are low its output goes high only on the 28th day of the second month of the year, on every year but leap year. Since lead 478 is the decode of the years counter and goes low only every four years on leap year which in turn makes lead 482 go high inhibiting NOR gate 410 and enabeling NOR gate 476. NOR gate 476 is also connected by leads 470, 472 and 474 who in turn decode the months counter to 29. Therefore NOR gate 476 goes high every fourth year on leap year on the 29th day of the month.

For advancing the count of circuit 46 at the conclusion of 30 days for the fourth sixth, ninth and eleventh months, gates 422, 428, 434 and 450 with connecting leads 438, 436, 426 and 424 and gate 440 with leads 442 and 444 decode out those months with 30 days. This decoded output with a proper signal on lead 484 into NAND gate 454 gives an output on 454 at midnight on the 30th of the month. If the month is a 31 day month lead 486 becomes true. Lead 486 and the output of gate 454 are NORed in gate 456 making its output go high for either occurance and then go low through inverter 458. Inverter 458 going low, in conjunction with lead 460 going low, which can occurr during counts 11 to 12 and 31 to 32, will drive gate 411 high at these times.

Gates 411, 410 or 476 are NORed into gate 418 whose output goes low when any of 410, 411 and 476 are true. The low output of 418 is inverted by 420 making its output a high. This high in conjunction with lead 468 being high during the counter for date being in the count between 20 and 40 causes gate 462 to be true and going low. Gate 462 going low sets, set-reset flip flop made up of gates 466 and 464 making the output of 464 high which resets the date counter to one. One half second later the flip flop is reset by lead labeled "to 30" and the next months count is started.

Figure 7:
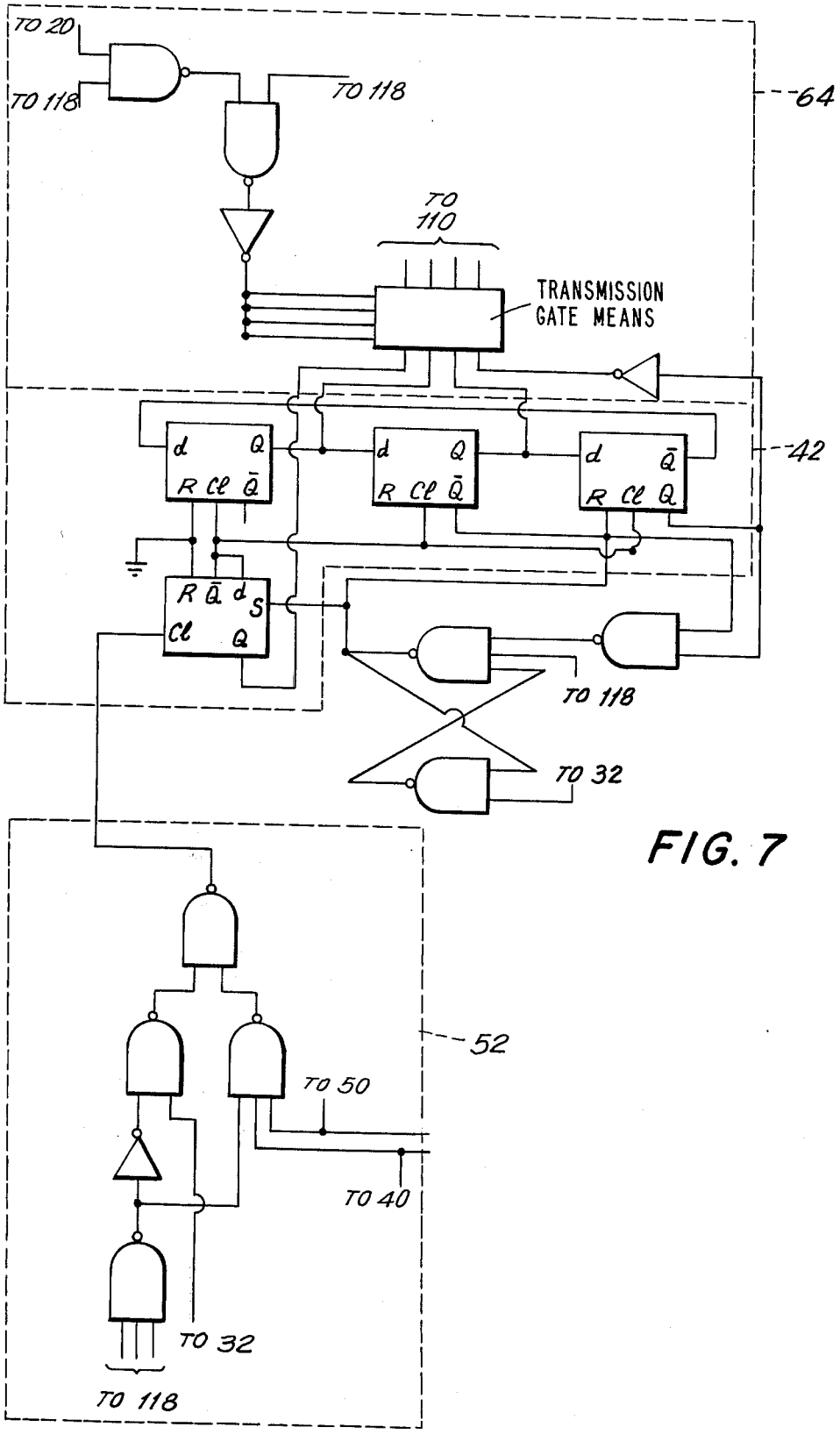
FIG. 7 is a circuit for counter 42 and its gate menas.
Figure 8:
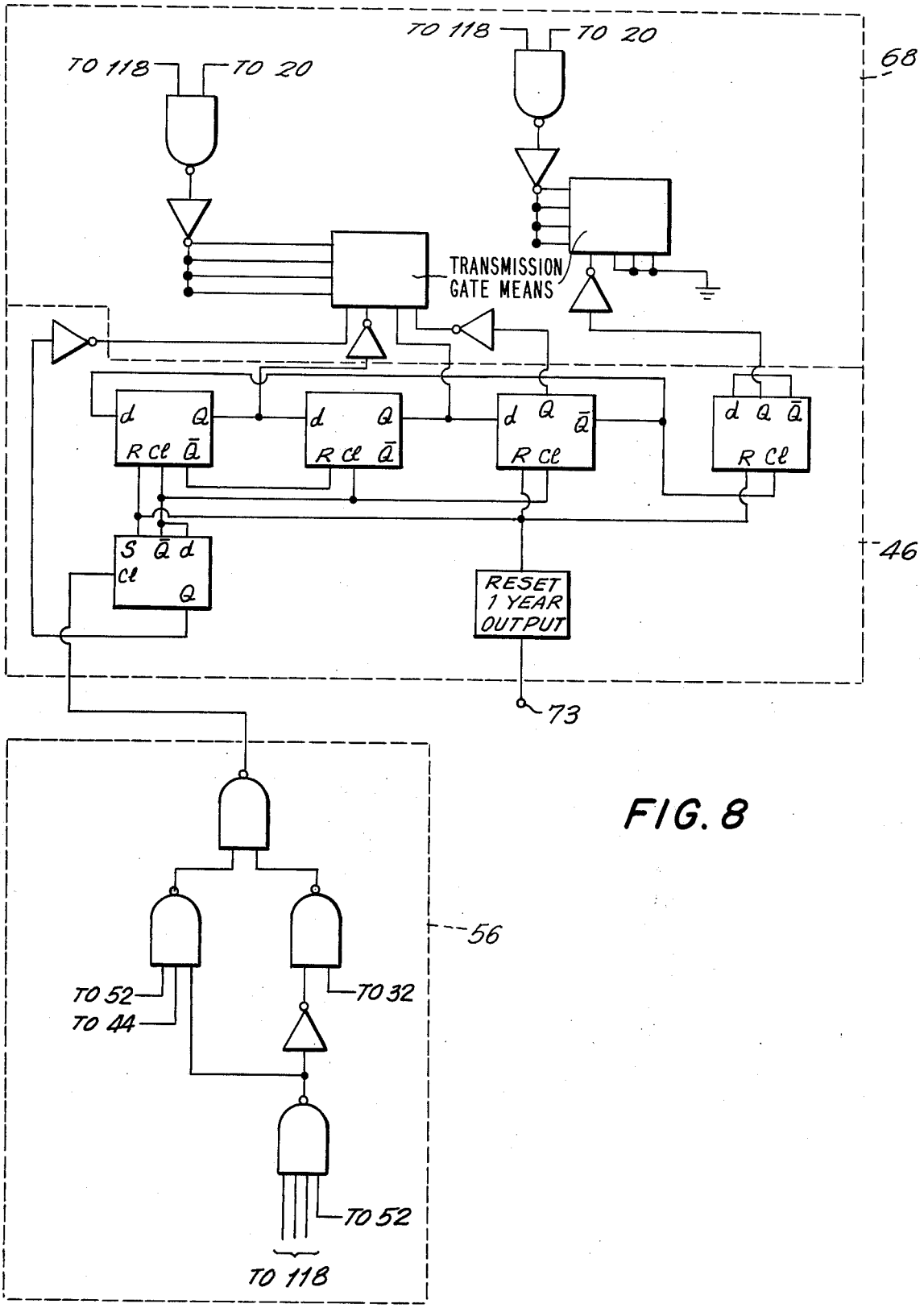
FIG. 8 is a circuit for counter 46 and its gate means.

The counter circuits 42 and 46 and gate means 52, 56 and 64,68 can be readily seen to comprise similar flip-flop shift register circuitry or binary shift register circuitry from an examination of FIGS. 7 and 8, respectively. In that the operative connection is believed readily apparent from these figures in view of the explanation of FIGS. 2 and 4 it is not believed necessary to further elaborate on them for those skilled in the art.

The decoder encoder 112 that produces the information to drive the display has the capability of displaying the days of the week either in numeric or alpha characters as shown below.

| Day of week | Numeric | Alpha |
|---|---|---|
| Monday | 1 | MO |
| Tuesday | 2 | TU |
| Wednesday | 3 | WE |
| Thursday | 4 | TH |
| Friday | 5 | FR |
| Saturday | 6 | SA |
| Sunday | 7 | SU |

The numeric information is displayed during ds 2 time in alpha, the first letter is done during ds1 time and the second letter during ds 2 time.

Therefore, for any given day of the week the decoder encoder must be capable of delivering any of three pieces of character information. For alpha information, for example, on Monday the M character information is delievered during ds1 time and the 0 information during the ds2 time. If a numeric output is desired the ds1 character must be blanked and the ds 2 character must be the information of the numeral required during that period.

In order to accomplish this the decoder - encoder is made up of three separate decoder encoders each one enabled by the selecting of the desired type of display.

There is a lead similar to lead 183 to the decoder encoder 112 which if connected to B+ gives numeric information for the days of the week and if connected to B− delivers alpha information. This one or zero information enables gates which in turn select the proper decoder encoder at the proper time.

OPERATION

In so far as it is not readily apparent from the foregoing description, the operation of the aforementioned circuitry may be set forth in reference to a time keeping device that is excited by a crystal within the DC operated frequency oscillator 10 or by an AC source of 120 cycles as in a line. The 30.720 KH$_Z$ signal is divided down by eight static binaries in the divider 12 to 120 HZ as at 142 which can be used to connect the line AC or as a calibration point.

This 120 H$_Z$ frequency is put into a divide by two circuit 18 thence through a decoder 20 to a divide by 6 and divide by 10 circuits 26 and 30 to provide a steady 1H$_Z$ frequency for line 32. As the decoder 20 also is provided with the 120 HZ signal it is capable of producing four digit select pulses by decoding the 120HZ and 60HZ signals to be supplied to a digit driver connected as one source to display segments 122, 124, 126 and 128, and to transmission gate means 58, 60, 62, 64, 66 and 68 so that selected information may be segregated in time for proper display independantly of other information.

The 1H$_Z$ pulsing of line 32 is continued down the divider chain and is again divided to provide information of seconds and an output of each 60th second by circuit 36 and gate 48. In the embodiement shown the transmission gate 58 may be activated by switches 134 and 138 of control 118 to provide seconds count to decoder-encoder 112 for driving segment driver 114 connected to various segments of respective LED's 122 and 124 for providing tens of seconds information on LED 124 during the ds 3 time and units of information on the LED 122 during the ds 4 time.

The 1 pulse per minute from gate 48 is applied to circuit 38 continously and divided to provide information of minutes and an output at each 60th minute to gate 50. The tens of minutes and units of minutes will be, as with the seconds, displayable by LED's 124 and 122 during the ds 3 and ds 4 times upon actuation of switch 134 of control 118. The one pulse per minute is continously fed to gate 50 and is divided by circuit 40 to provide hours information and an output pulse at the exact conclusion of each day to gates 52 and 54. The tens of hours and units of hours may be brought forth to LED's 128 and 126, respectively, by closing switch 134 during the ds1 and ds2 times of decoder 20.

The output pulse of circuit 40 is via gates 52 and 54 fed to independent day circuits 42 and 44 which, respectively divide out pulses of the day of the week and day of the month for their transmission gates 64 and 66. The day of the month circuit 44 has memory means to provide an output on the exact hour of the end of the last day of each month for gate 56. Actuation of switch 138 will call forth the information of the tens of days and units of days during decoder 20's ds 3 and ds 4 time on LED's 124 and 122. Upon combined operation of switches 134 and 138 the day of the week is called forth for LED's 128 and 126 for alpha or numeric display thereby during decoder 20's ds2 time for alpha display and during its ds1 and ds2 time for numeric display.

The circuit 46 receives the output of circuit 44 via a gate means 56 and divides out the tens of months and units of months for transmission gate 68 and provides an output pulse at 73 at the conclusion of the last hour of the last day of the last month of each year which may be directed to lead 478. Switch 138 may be actuated to display such information on LED's 128 and 126 during decoder 20's ds 1 and ds 2 times.

In order to program each of the circuits 38, 40, 42, 44 or 46 the switch 136 alone or in combination with switches 134 and/or 138 is actuated to activate delay circuit 34 and apply a signal to gates 48, 50, 52, 54 or 56 while calling forth display information from gates 60, 62, 64, 66 and/or 68. More specifically application of switch 134 and then 136 will program the minutes circuit 38 until switch 136 is released with the circuit 40 being blocked from advancing. At the initiation of this setting procedure the seconds circuit 36 is reset to zero mementarily and then progresses again with its count.

Actuation of switch 136 alone through gate 60 blanks the minutes display of information from circuit 38 and after a small delay progresses the circuit 40 at a second rate as long as switch 136 is held activated. Again the advance of the hours count is blocked from succeeding circuits by means of control connection to input gates thereof.

For setting the circuit 42, switches 134, 136 and 138 are simultaneously actuated, and for setting the circuit 44 switches 136 and 138 are actuated simultaneously. Circuit 46 is programed by actuating switch 138 and releasing and actuating switch 136.

In those setting operations where sequential switch operation is needed the delay allows the programming without the watch reacting.

As may be appreciated by those skilled in the art, the invention may be embodied in other specific forms without departing from the spirit or essential characteristics thereof. The present embodiements are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed by these Letters Patent is:

1. An electronic watch having a means to provide a frequency source from a time standard, a first electronic means to decode frequency signals from said source and provide selected digit pulse outputs at predetermined intervals, a digit driver connected to said first means, a display means connected to said digit driver, a binary divider chain connected to said frequency source continuously operable with counter means to provide pulses representative of seconds, minutes, hours, days of the month, days of the week and months in proper sequential order, said divider chain comprised of gate means to advance each portion thereof in accordance with pulses starting with the portion of the counter means providing pulses representative of seconds, said gate means comprised of a differentiator circuit of NOR gates and an advancing and setting circuit of NAND gates, decoder-encoder means connected to said binary divider chain, a segment driver connected to said decoder encoder means and said display means, and a control meas connected to said binary divider chain and said digit driver to control the activation of said display in indicating selected information of hours - minutes, days of the month- seconds, days of the week- months at selected pulses from said decoder.

2. The structure of claim 1 wherein said control means is connected to gate means controlling the input to a computer means and transmission gate means of said binary chain to program said computer means and selectively call forth information therefrom at preselected time intervals for said optical display.

3. The structure of claim 2 wherein said computer means includes:

A seconds circuit having a series connection of a toggling flip flop and shift registers for providing a count of tens of seconds connected to said source, and a series combination of a toggling flip-flop and shift registers for units of seconds connected to said source and to an input of the toggling flip-flop of the tens of seconds series connection.

4. The structure of claim 3 and further including a duplication of the series connections thereof operatively connected by a differentiator circuit and NAND gate advancing and setting means to the output from the tens of seconds series connection for counting the tens of minutes and units of minutes.

5. The structure of claim 4 wherein said series connections include:

A first binary having its clock input connected to gate means from the output of the tens of minutes shift register, its data input connected to its $\overline{Q}$ output, its set input connected to said tens of minutes shift register, and its Q output connected to a transmission gate;

A first shift register having R. CL, $\overline{Q}$, d and Q terminals with said CL terminal connected to the $\overline{Q}$ output of said first binary and its Q output connected to said transmission gate;

A second shift register with d, Q, R, CL and $\overline{Q}$ terminals, said d terminal being connected to said Q terminal of said first shift register, said R terminal connected to said Q terminal of said first shift register and to said transmission gate, said $\overline{Q}$ terminal to said transmission gate;

A third shift register having R, CL, Q, Q and d terminals said R terminal connected to said R terminal of said first shift register, said CL terminal connected to said Q output of said first binary, said Q terminal to said transmission gate, and said d terminal to said Q terminal of said second shift register;

A second binary having S, CL, Q, Q and *d* terminals, said S terminal being connected to said R terminal of said first shift register and said R terminal of said third shift register, said CL terminal being connected to said Q terminal of said third shift register, said *d* and Q terminals being connected together, and said Q terminal being connected to said transmission gate;

A third binary having S, CL, Q, Q and d terminals with said CL terminal connected to said Q terminal of said second binary, its *d* and Q terminal connected together and to said transmission gate, and its Q terminal connected to said transmission gate; and A plurality of gate means controlling connection of tens of minutes shift register output to the S inputs of said second and third binaries and to controlably relate the output of the first binary, the first shift register, the second binary and the third binary.

6. The structure of claim 5 and further including gate means connected to said first circuit a series connected toggling flip-flop, shift register circuit counting to seven connected to said gate means and a transmission gate means operably connected to said toggling flip-flop, shift register circuit; and means connected to said transmission gate to switch between alpha and numeric information delivery thereof.

7. The structure of claim 6 and further including gate means connected to said second circuit, a binary, shift register circuit counting to twelve connected to said gate means and a transmission gate means operably connected to binary, shift register circuit; and means connecting an output of said binary, shift register circuit to said second circuit.

8. The structure of claim 7 and further including memory means connected to said means connecting the output of said binary, shift register circuit to said second circuit to command said second circuit in accordance with the number of days in each month of the year.

9. The structure of claim 8 and further comprising decoder means connected to said source between same and said computer means to decode said source into selected pulse times controllably connected to transmission gates of said computer means.

10. The structure of claim 9 and further including a decoder - encoder having a plurality of parallel channels connected to several portions of said computer means for decoding and encoding information to be passed at selected pulse times.

11. The structure of claim 10 wherein said optical display includes a digit driver from said decoder and a segment driver connected to said decoder - encoder for selectively displaying information provided by said computer means.

12. The structure of claim 10 wherein said optical display further includes control means having switches to select information to be displayed and means to program said computer means.

13. The structure of claim 9 the binary divider chain has memory means including a first logic gate means for controlling the computation of days of the month during the second month of the year, a second logic gate means for controlling the computation of the days of the month during the fourth, sixth, ninth and eleventh month of the year, and a third logic means for controlling the computation of the days of the month during the remaining months of the year.

14. The structure of claim 13 wherein said memory means is controlled by signals from a monthly counter included in said divider chain.

15. The structure of claim 14 wherein said first logic gate means and second logic gate means are in parallel and operative connection with said third logic means to render it inoperative whenever said first or second logic means is operative.

16. The structure of claim 13 with said first logic means comprising parallel NOR gates, one for 28 day months and one for 29 day months occurring every leap year.

17. The structure of claim 13 wherein said first logic gate means and second logic gate means are in parallel and operative in connection with said third logic means to render it inoperative whenever said first logic gate or second logic gate means is operative.

18. The structure of claim 17 with said first logic means comprising parallel NOR gates, one for 28 day months and one for 29 day months for the second month of a year.

* * * * *